US006179051B1

(12) United States Patent
Ayub

(10) Patent No.: US 6,179,051 B1
(45) Date of Patent: Jan. 30, 2001

(54) DISTRIBUTOR FOR PLATE HEAT EXCHANGERS

(75) Inventor: Zahid H. Ayub, Arlington, TX (US)

(73) Assignee: Delaware Capital Formation, Inc., Wilmington, DE (US)

( * ) Notice: Under 35 U.S.C. 154(b), the term of this patent shall be extended for 0 days.

(21) Appl. No.: 08/998,085

(22) Filed: Dec. 24, 1997

(51) Int. Cl.[7] ..... F28F 3/08
(52) U.S. Cl. ..... 165/167; 165/174; 137/561 A
(58) Field of Search ..... 165/174, 167, 165/166; 137/561 A

(56) References Cited

U.S. PATENT DOCUMENTS

| | | | | |
|---|---|---|---|---|
| 2,099,186 | * | 11/1937 | Anderegg | 165/174 |
| 2,596,008 | | 5/1952 | Collins . | |
| 2,905,447 | * | 9/1959 | Huet | 165/174 |
| 3,114,686 | | 12/1963 | Edwards et al. . | |
| 3,240,268 | | 3/1966 | Armes . | |
| 3,908,758 | * | 9/1975 | Armonies et al. | 165/174 |
| 4,002,201 | | 1/1977 | Donaldson . | |
| 4,006,776 | | 2/1977 | Pfouts et al. . | |
| 4,116,268 | * | 9/1978 | Krüger | 165/174 X |
| 4,202,182 | | 5/1980 | Kawashima et al. . | |
| 4,309,987 | * | 1/1982 | Higgins, Jr. | 165/174 X |
| 4,340,114 | | 7/1982 | Levy . | |
| 4,470,455 | | 9/1984 | Sacca . | |
| 4,513,587 | | 4/1985 | Humpolik et al. . | |
| 4,524,823 | | 6/1985 | Hummel et al. . | |
| 4,569,391 | | 2/1986 | Hulswitt et al. . | |
| 4,586,562 | | 5/1986 | Carlson et al. . | |
| 4,589,480 | * | 5/1986 | Dahlgren | 165/174 X |
| 4,593,539 | | 6/1986 | Humpolik et al. . | |
| 4,653,581 | | 3/1987 | Yogo et al. . | |
| 4,665,975 | | 5/1987 | Johnston . | |
| 4,815,534 | | 3/1989 | Fuerscbach . | |
| 4,987,955 | | 1/1991 | Bergqvist et al. . | |
| 5,291,945 | | 3/1994 | Blomgren et al. . | |
| 5,651,268 | | 7/1997 | Aikawa et al. . | |
| 5,682,945 | | 11/1997 | Lehman . | |

FOREIGN PATENT DOCUMENTS

| | | | | |
|---|---|---|---|---|
| 0121079 | * | 10/1984 | (EP) | 165/174 |
| 788045 | * | 6/1956 | (GB) | 165/174 |
| 355472 | * | 11/1972 | (SU) | 165/174 |
| 1126802 | * | 11/1984 | (SU) | 165/174 |

OTHER PUBLICATIONS

Thermofluid International, Bazed Plate Exchangers for Refrigeration and Air Conditioning Appl.,1996.

Thermofluid International, Flood–X, Unique Plate and Frame Evaporator, 1995.

* cited by examiner

*Primary Examiner*—Christopher Atkinson
(74) *Attorney, Agent, or Firm*—Geoffrey A. Mantooth

(57) ABSTRACT

A heat exchanger has stacked plate elements that are joined together so as to form first and second sets of channels. Each set of channels has an inlet port and an outlet port to allow fluid to flow in and out of the channel in the set. A distributor is located in the inlet port of the first set. The distributor has a first and a second end, with the distributor first end being located near a fitting in the inlet port, and the distributor second end being located near a rear plate of the heat exchanger. The presence of the distributor in the inlet port forms a passage for fluid flow into the respective channels. The passage is larger at the distributor first end than at the distributor second end. The passage can be formed by channels or grooves in the outside diameter of the distributor. Alternatively, the passage can be formed by variations in the outside diameter between the first and second ends of the distributor. For example, such a distributor could be frustoconical in shape.

7 Claims, 4 Drawing Sheets

DISTRIBUTOR FOR PLATE HEAT EXCHANGERS

FIELD OF THE INVENTION

The present invention relates to heat exchangers in general, and more specifically to plate type heat exchangers.

BACKGROUND OF THE INVENTION

Plate heat exchangers, such as the brazed and plate and frame types, are typically used in refrigeration and air conditioning applications. A brazed plate heat exchanger is shown in U.S. Pat. Nos. 4,987,955 and 5,291,945. The heat exchangers, which are low in cost and relatively simple to make, can be used as evaporators, condensers, heat pumps, and a variety of other equipment.

A plate heat exchanger is made up of a series of stacked thermally conductive plates. In between the plates are channels. In an evaporator mode, a refrigerant fluid flows through the alternating channels. Heat transfer occurs from the other fluid across the plates. The refrigerant fluid is injected into the heat exchanger at one end and exits at the other end.

The problem with these type of heat exchangers is that the refrigerant may be a mixture of two phases, namely a liquid and a gas. A typical situation is when a heat exchanger is placed downstream of an expansion valve. The liquid separates from the gas, resulting in an uneven distribution throughout the exchanger. Gravity causes the separation. Some channels may receive mostly liquid, while other channels may receive mostly gas. Uneven distribution results in a loss of capacity and efficiency.

Therefore, it is desirable to provide a plate heat exchanger that maintains the distribution of a homogeneous two phase refrigerant flowing therethrough.

SUMMARY OF THE INVENTION

It is an object of the present invention to provide an apparatus for a plate heat exchanger that maintains even distribution of all phases of the refrigerant flowing therethrough.

It is another object of the present invention to provide an apparatus for a plate heat exchanger that maintains the distribution of all phases of the refrigerant flowing therethrough in a simple and inexpensive manner.

A heat exchanger has stacked plate elements joined together so as to form first and second channels, with each of the first and second sets of channels being sealed so as to contain a respective fluid therein. The channels of the first set are interspaced with the channels of the second set. Each of the first set and the second set of channels have an inlet and outlet that communicate with the respective channels of the set. The heat exchanger has a distributor located in the inlet of the first set. The first set inlet has a first end and a second end. The heat exchanger has a fitting located adjacent to the first end of the first set inlet. The fitting is structured and arranged to be coupled to a fluid conduit. The distributor includes a first end and a second end. The distributor first end is located in the first end of the first set inlet and the distributor second end is located in the second end of the first set inlet. The distributor forms a passage in the first set inlet that extends from the first set inlet first end to the first set inlet second end and that allows communication between the fitting and the channels of the first set. The passage is larger at the distributor first end than at the distributor second end.

In one aspect of the present invention, the passage is formed by a groove located in an outside surface of the distributor. The passage can extend either parallel to a longitudinal axis of the distributor or in a spiral around the distributor.

In another aspect of the present invention, the distributor has plural passages located on the outside surface thereof.

In still another aspect of the present invention, the passage around the distributor is formed by a difference in the outside diameters of the distributor first and second end, with the first end having a smaller outside diameter than the distributor second end.

The distributor of the present invention provides a simple and inexpensive device for maintaining an even refrigerant flow through a plate type heat exchanger. The inclusion of the distributor in a heat exchanger minimizes the possibility that the refrigerant will undergo a separation of liquid from gas inside the heat exchanger.

Plate heat exchangers can vary in depth, according to the number of plates therein. The distributor can be fabricated from a compatible material (either machined or extruded) in a rod-shape, which rod is cut to length to match the depth of the inlet port of the heat exchanger.

DESCRIPTION OF THE PREFERRED EMBODIMENTS

Figure 1:
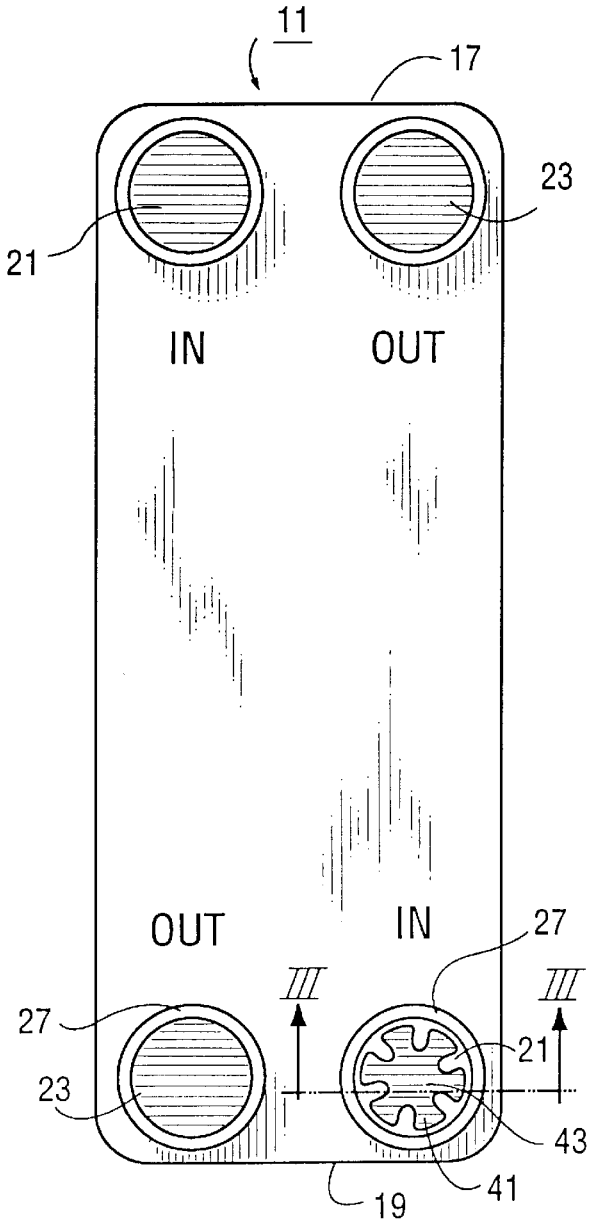
FIG. 1 is a front view of a brazed plate heat exchanger, showing the distributor of the present invention therein, in accordance with a preferred embodiment.
Figure 2:
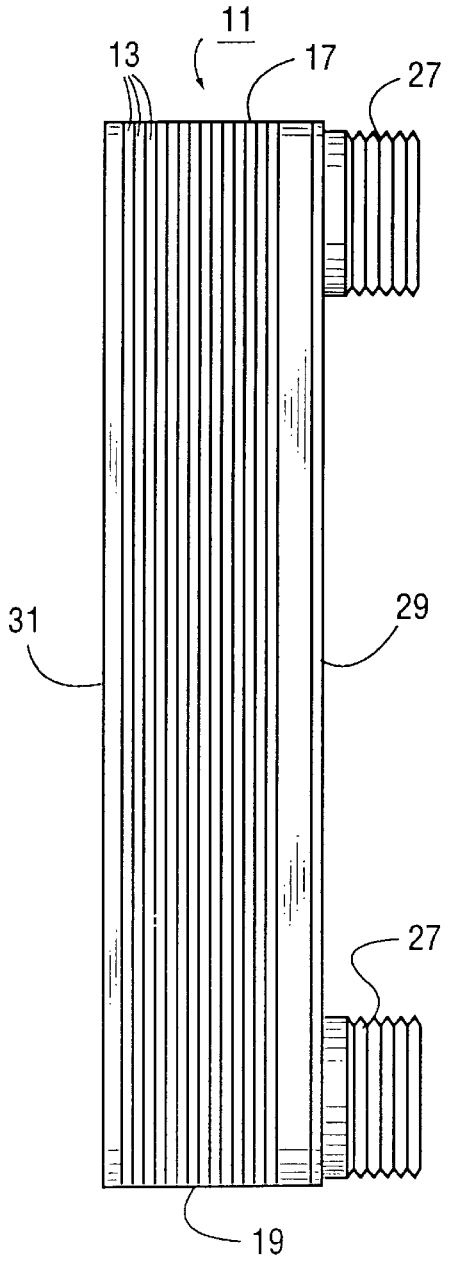
FIG. 2 is a side view of the heat exchanger.

In FIGS. 1 and 2, there are shown views of a plate type heat exchanger 11 which incorporates the present invention. The heat exchanger 11 is made up of a plurality of plates 13, stacked together. U.S. Pat. Nos. 4,987,955 and 5,291,945 show and describe plate heat exchangers. The disclosures, including the descriptions and the drawings, of U.S. Pat. Nos. 4,987,955 and 5,291,945 are incorporated herein. The plates 13 can be single plates, or as shown in U.S. Pat. No. 5,291,945, double plates.

The present invention can be used in plate heat exchangers such as brazed plate heat exchangers and plate and frame heat exchangers.

The stacked plates 13 have channels therebetween, which channels allow fluid therein. In a brazed plate heat exchanger, the plates are joined and sealed together by brazing or soldering. The brazing can be either copper or nickel (preferred for ammonia applications). In a plate and frame heat exchanger, welded plate pattern pairs (called cassettes) are gasket sealed and manufactured as a pack between two end plates via studs and nuts.

Figure 3:
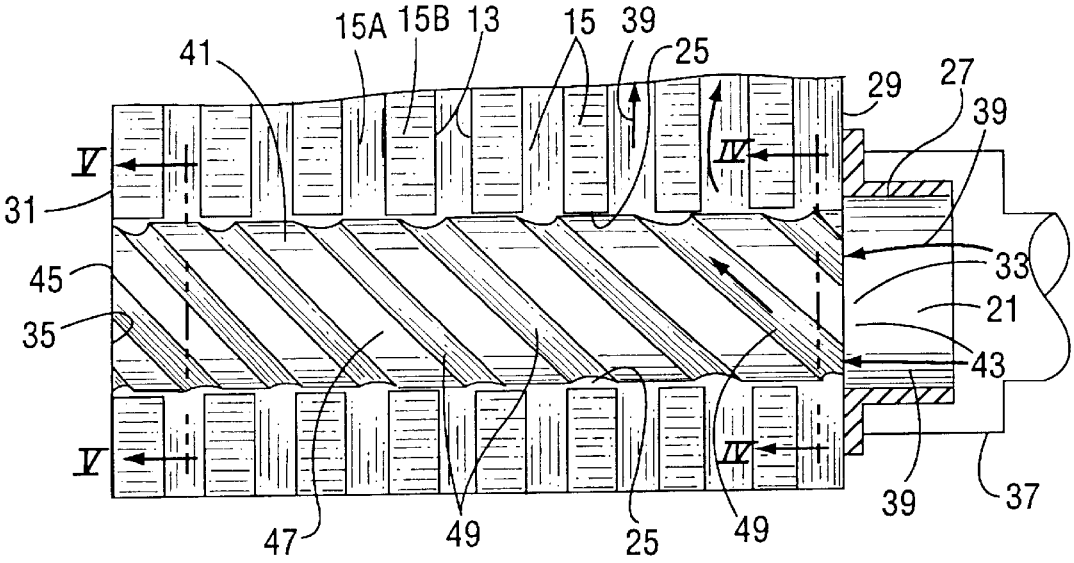
FIG. 3 is a schematic cross-sectional view of an inlet port of the heat exchanger, showing the distributor located therein, with the cross-section being taken through lines III—III of FIG. 1.
Figure 6:
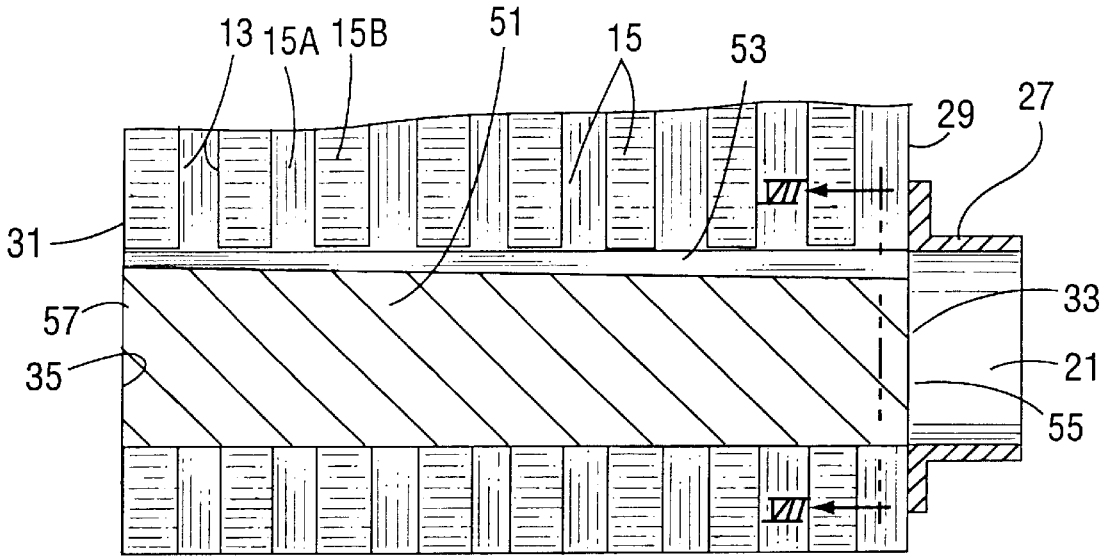
FIG. 6 is a schematic cross-sectional view of the inlet port of the heat exchanger, shown with a distributor in accordance with a second embodiment.
Figure 8:
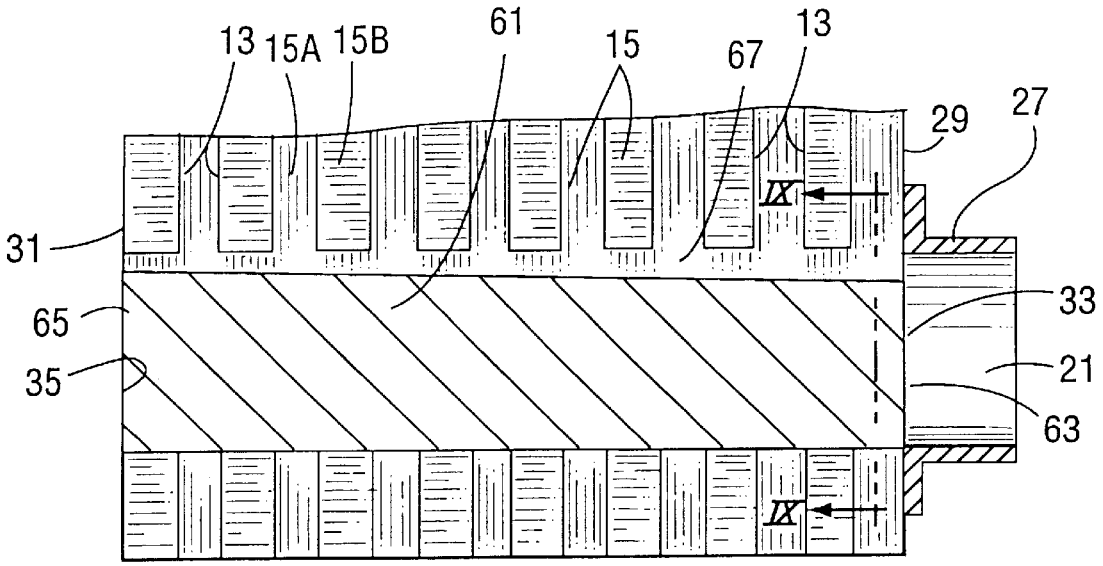
FIG. 8 is a schematic cross-sectional view of the inlet port of the heat exchanger, shown with a distributor in accordance with a third embodiment.

Each plate has corrugations. When the plates are stacked together, the corrugations of adjacent plates are aligned with respect to each other so as to form channels 15 (see FIG. 3). In FIGS. 3, 6 and 8, the plates 13 and channels 15 are shown schematically. The plates 13 are sealed together in such a way so as to form first and second sets 15A, 15B of channels between the plates. Fluid in the first set of channels is sealed from entering the second set of channels and vice versa. The first and second sets 15A, 15B of channels are interspaced relative to each other. The channels of the first set are separated from the adjacent channels of the second set by the plates 13.

The plates 13 are generally rectangular in shape. (However, the plates could be any shape, such as circular.) Likewise, the heat exchanger 11 is generally rectangular shape. The heat exchanger 11 has a first end 17 and a second end 19 (see FIG. 1).

Each of the sets of channels has an inlet port 21 and an outlet port 23. For each set of channels, the inlet port 21 is located at one end, while the outlet port 23 is located at the opposite end of the heat exchanger. The ports 21, 23 are formed by openings 25 in the plates 13 (see FIG. 3 for an example of an inlet port). The inlet and outlet ports communicate with each of the channels in the respective set. Thus, the inlet and outlet ports of the first set communicate with each channel of that first set. Likewise, the inlet and outlet ports of the second set communicate with each channel of that second set. It is preferred that the inlet port of the first set be located at the opposite end from the inlet port of the second set, although this need not always be the case. Such an arrangement provides for counterflow of one fluid against the other fluid.

The ports 21, 23 are generally located in the corners on one face of the heat exchanger. Each port is provided with a fitting 27 to receive a fluid conduit, such as a hose 37 or pipe. In the preferred embodiment, the fittings 27 are threaded or sweated nipples. As shown in FIG. 3, each port extends through a front plate 29 of the heat exchanger to a rear plate 31. The rear plate 31 is unperforated. The inlet port 21 has a front end 33 adjacent to the front plate 29, and a rear end 35 adjacent to the rear plate 37.

An advantage of a plate heat exchanger is that heat exchangers of varying capacity can be manufactured simply. If a heat exchanger is to have more heat transfer capability, then more plates 13 can be added to the basic design. This creates more channels for fluid to flow into. If less capability is desired, fewer plates are utilized. The depth (the distance from the front plate 29 to the rear plate 31) of the heat exchanger is determined by the number of plates 13 in the heat exchanger. Likewise, the depth of each port 21, 23 is determined by the number of plates 13.

Fluid flows into the heat exchanger through a respective inlet port 21, through the respective channels 15 between the plates, and out through a respective outlet port 23. A first fluid flows into one of the inlet ports, while a second fluid flows into the other inlet port. As the first and second fluids flow through the heat exchanger, they do not intermix, as the fluids are confined to the respective sets of channels. Heat exchange from one fluid to the other occurs through the plates separating the two fluids.

FIG. 3 shows a cross-sectional view of an inlet port 21. As can be seen, the port 21 communicates with all of the channels 1SA in the respective set. The openings 25 of the plates 13 are of a constant diameter from the front end 33 of the port to the rear end 35.

As the fluid 39 enters the inlet port 2 1, it flows into the channels 15A of the respective set. Ideally, the fluid should flow equally into all of the channels 15A. Thus, the same amount of fluid should flow into the channels near the front plate 29 as in the channels near the rear plate 31. Also, the fluid should flow over all of the available surface area of the plates that define the channels. Unfortunately, such equal and even flow can be difficult to obtain.

In a DX (Direct Expansion) system refrigerant fluid entering the heat exchanger is a mixture of gas and liquid (for example 20% gas, 80% liquid by weight). Some of the fluid enters the channels 15A near the front plate 29. Thus, the overall mass of the fluid decreases from the front end 33 to the rear end 35 of the inlet port. This produces a drop in the velocity of the fluid. As the fluid velocity drops, gravity works to separate the liquid from the gas. Consequently, some channels receive more liquid, while other channels, receive more gas. The distributor provides a passage that compensates for the loss of fluid mass and therefore maintains the fluid velocity from the front end of the inlet port to the rear end.

The present invention provides a distributor 41 in the inlet port 21 of the heat exchanger 11. (In FIG. 3, the distributor 41 is not shown in cross-section.)

In the preferred embodiment, there need only be a distributor in the refrigerant inlet port. The other inlet port need not be equipped with a distributor, although a distributor can be provided if desired.

The distributor 41 is generally cylindrical in shape so as to generally conform to the shape of the plate openings 25 in the inlet port 21. The distributor has a front end 43 and a rear end 45, and a wall or body 47 that extends between the two ends.

When inserted into the inlet port 21, the distributor rear end 45 is adjacent to the rear end 35 of the port and the distributor front end 43 is adjacent to the front end 33 of the port. One or more passages 49 are formed around the outside diameter of the distributor 41. The passages 49 permit fluid to flow from the inlet port 21 into the channels 15A communicating with that port.

The size of the passages 49 decreases as the passages traverse from the front end 33 of the port 21 to the rear end 35. Specifically, the cross-sectional area of the passages decreases from the front end to the rear end of the inlet port. This reduction in size forces the fluid to maintain its velocity, even at the rear end of the inlet port. Consequently, the liquid stays mixed with the gas.

The passages 49 can be formed in several ways. In FIG. 3, there are plural grooves 49 in the outside diameter of the distributor 41. The grooves spiral around the circumference of the distributor, in order to provide fluid to various circumferential locations of the inlet port.

The refrigerant traverses through the heat exchanger from the respective inlet to the respective outlet. In an evaporator, the liquid refrigerant changes to a gas, such that all of the refrigerant is gaseous when exiting the heat exchanger. Some oil will be mixed in with the refrigerant, which oil remains liquid. The oil is from the compressor.

Figure 5:
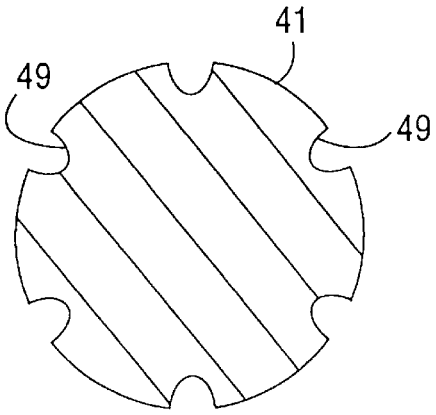
FIG. 5 is a cross-sectional of the distributor of FIG. 3, taken through lines V—V of FIG. 3.
Figure 4:
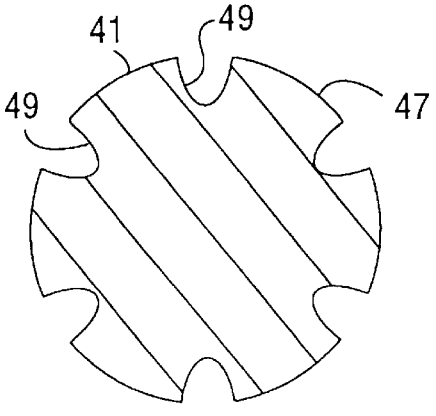
FIG. 4 is a cross-sectional view of the distributor of FIG. 3, taken through lines IV—IV of FIG. 3.

FIGS. 4 and 5 show transverse cross-sections of the distributor. As can be seen, the cross-sectional area of the grooves 49 near the front end 43 is greater than the cross-sectional area of the grooves near the rear end 45. The grooves 49 are deeper at the front end 43 than at the rear end 45. For example, that section of the grooves that are located near the front end have a depth of three eighths of an inch (see FIG. 4), while the grooves that are located near the rear end have a depth of one fourth of an inch (see FIG. 5). Also, as an example, the angle that the grooves make with a longitudinal axis of the distributor is about 45 degrees.

The outside diameter of the distributor 41 is slightly less than the inside diameter of the plate openings 25. The fluid flows into the individual passages 49, exiting the passages to flow into the channels 15A between the plates. The fluid flowing into the rear channel has about the same velocity as the fluid flowing into the front channel, thereby minimizing any maldistribution.

Figure 7:
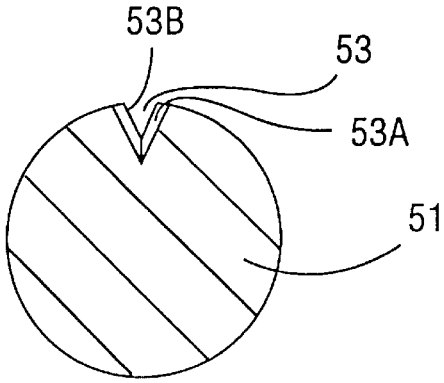
FIG. 7 is a cross-sectional view of the distributor of FIG. 6, taken through lines VII—VII of FIG. 6.

FIGS. 6 and 7 show a second embodiment of the distributor 51. The distributor 51 has a single passage or groove 53 in its outside diameter. As shown in FIG. 7, the transverse cross-sectional area 53A of the groove located near the front end 55 is greater than the transverse cross-sectional area 53B of the groove located at the rear end 57. The groove traverses in a direction that is parallel to the longitudinal axis of the distributor. The distributor 51 can be provided with one or more such grooves depending upon the refrigeration capacity of the system. The groove can be of any cross-sectional shape. The groove 53 can be oriented at any position inside of the inlet port. It thought to be preferable if the groove is located downwardly.

Fluid flowing into a heat exchanger equipped with the distributor 51 flows into the restricted inlet port by way of the passage 53 and then into the channels 15A.

Figure 9:
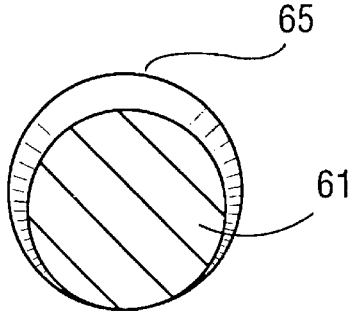
FIG. 9 is a cross-sectional view of the distributor of FIG. 8, taken through lines IX—IX of FIG. 8.

FIGS. 8 and 9 show a third embodiment of the distributor 61. The distributor 61 has a varying outside diameter. The front end 63 has a smaller outside diameter than does the rear end 65. The distributor 61 can be frusto-conical in shape, or as shown in FIGS. 8 and 9, eccentric. A passage 67 for fluid flow is located around the outside diameter of the distributor 61. The transverse cross-sectional area of the passage 67, which is crescent shaped, is larger at the front end 33 of the inlet port than at the rear end 35.

When the distributor 61 is inserted into an inlet port, the inlet port 21 is restricted by the front end 63 of the distributor 61. Fluid flows into the passage 67 and then into the channels 15A.

The distributors 41, 51, 61 can be made of a variety of materials, such as metal or plastic. It can be solid or hollow. The distributors are simple to manufacture. They can be molded or machined.

An advantage of a plate heat exchanger is the ease of designing for capacity. If more volumetric capacity is needed, then the heat exchanger can be provided with more plates. Varying the number of plates varies the depth of the heat exchanger, as well as the depth of the inlet port.

The distributor 41, 51, 61 can be manufactured as a long rod. When fitting a heat exchanger with a distributor, the distributor is merely cut to length to fit into the inlet port 21. For example, the length of the distributor can be measured from the rear end. The distributor is then located in the inlet port, with the distributor rear end adjacent to, or abutting against, the heat exchanger rear plate 31. The distributor need not be retained inside of the port. A hose or pipe is then connected to the fitting 27. Thus, installation is simple and inexpensive.

The passage or passages in the distributor communicate with all of the channels 15A in the respective set. Thus, the passage or passages are common to all channels 1SA. For example, referring to FIG. 3, each passage 49 communicates with all of the channels 15A. Likewise in FIG. 6 and in FIG. 8, the passages 53, 67 communicate with all of the channels.

The foregoing disclosure and the showings made in the drawings are merely illustrative of the principles of this invention and are not to be interpreted in a limiting sense.

I claim:

1. In a heat exchanger having stacked plate elements joined together so as to form first and second sets of channels, each of the first and second sets of channels being sealed so as to be structured and arranged to contain a respective fluid therein, the channels of the first set being interspaced with the channels of the second set, each of the first set and the second set having an inlet and an outlet that communicates with the respective channels of the set, the inlet being formed by openings in the plate elements, comprising:

a) a distributor located in the inlet of the first set;

b) the first set inlet having a first end and a second end, the heat exchanger having a fitting located adjacent to the first end of the first set inlet, the fitting being structured and arranged to be coupled to a fluid conduit;

c) the distributor comprising a first end and a second end, the distributor first end being located in the first end of the first set inlet and the distributor second end being located in the second end of the first set inlet, the distributor forming a passage in the first set inlet that extends from the first set inlet first end to the first set inlet second end and that allows communication between the fitting and the channels of the first set, the passage being larger at the distributor first end than at the distributor second end;

d) the first set inlet second end being unperforated by the distributor second end, the distributor second end bearing on one or more of the openings in the plate elements at the inlet second end;

e) the first end of the distributor bearing on one or more of the openings in the plate elements at the inlet first end.

2. The heat exchanger of claim 1 wherein the passage is formed by a groove located in an outside diameter of the distributor.

3. The heat exchanger of claim 2 wherein the passage extends in a spiral around the distributor.

4. The heat exchanger of claim 2 wherein the passage extends parallel to a longitudinal axis of the distributor.

5. The heat exchanger of claim 2 further comprising plural passages located in the outside surface of the distributor.

6. The heat exchanger of claim 1 wherein the passage is formed by a difference in outside diameters of the distributor first and second ends, with the distributor first end having a smaller outside diameter than the distributor second end.

7. The heat exchanger of claim 1 wherein the distributor first end is blunt.

* * * * *